US005170607A

United States Patent [19]

Kallmann

[11] Patent Number: 5,170,607

[45] Date of Patent: Dec. 15, 1992

[54] METHOD OF TWISTING A FEED YARN WOUND UNDER LITTLE TENSION

[75] Inventor: Jürgen Kallmann, Kaarst, Fed. Rep. of Germany

[73] Assignee: Palitex Project Company GmbH, Krefeld, Fed. Rep. of Germany

[21] Appl. No.: 660,523

[22] Filed: Feb. 25, 1991

[30] Foreign Application Priority Data

Feb. 26, 1990 [EP] European Pat. Off. ..... 4005788.7

[51] Int. Cl.[5] ..... D01H 7/74; D01H 1/08

[52] U.S. Cl. ..... 57/312; 57/76

[58] Field of Search ..... 57/76, 77, 312, 58.83, 57/58.52

[56] References Cited

U.S. PATENT DOCUMENTS

| | | | |
|---|---|---|---|
| 1,813,611 | 7/1931 | Dickie et al. | 57/62 X |
| 1,955,719 | 4/1934 | Malkomes | 57/75 X |
| 2,574,455 | 11/1951 | Abbott | 57/312 |
| 2,630,280 | 3/1953 | Wedler | 57/312 X |
| 2,667,773 | 2/1954 | Bolelli | 57/312 |
| 3,545,698 | 12/1970 | Medney | 242/128 |
| 4,097,004 | 6/1978 | Reese | 242/129.72 |
| 4,125,992 | 11/1978 | Kallmann | 57/58.83 |

FOREIGN PATENT DOCUMENTS

| | | |
|---|---|---|
| 572050 | 2/1933 | Fed. Rep. of Germany . |
| 1123239 | 2/1962 | Fed. Rep. of Germany . |

OTHER PUBLICATIONS

"Zwei Jahre Erfahrungen mit Spinnfachmaschinen—das PLYfiL-System", pp. 707-710, Textil Praxis International, Jul. 1989.

*Primary Examiner*—Daniel P. Stodola
*Assistant Examiner*—John Rollins
*Attorney, Agent, or Firm*—Bell, Seltzer, Park & Gibson

[57] ABSTRACT

A method of twisting a feed yarn of little strength, which is wound under little tension on a winding tube into a yarn package, wherein the wound yarn package with the winding tube is inserted into a spindle pot, the spindle pot is put in rotation, the winding tube is subsequently pulled out of the yarn package, and the feed yarn is then withdrawn from the inside surface of the yarn package and wound to a package or twist package.

6 Claims, 2 Drawing Sheets 4
3
2
1

3
4
6
5

3
4
6
5
7
9
2'
8
4'
4

METHOD OF TWISTING A FEED YARN WOUND UNDER LITTLE TENSION

FIELD OF THE INVENTION

The present invention relates to a method of strengthening and/or twisting a feed yarn of little strength, which is wound under light tension on a tube to form a yarn package.

BACKGROUND TO THE INVENTION

So-called air-spun yarns are known, which are produced wherein a fibrous sliver is drawn in a high-speed drafting system and fed to a spinning system using an air nozzle. In this process, specially constructed air nozzles engage with a portion of the external fibers of the sliver and wrap same spirally around the fiber strand. As a result the fiber strand receives very little strength, which nonetheless suffices to wind the drawn and slightly strengthened roving downstream of the nozzle head, for example, into a cross-wound package. Such air-spun yarns also form the basis for plied yarns, which are available on the market, for example, under the brand name "Plyfil". "Plyfil" is a trademark of Spindlefabrik Suessen Schurr, Stahlecker & Grill GmbH of Germany and relates to a system of forming yarns. The "Plyfil" system proceeds from combining two of such drawn and slightly strengthened rovings from two adjacent spinning pots, i.e., two individual strands are plied and both strands are jointly wound into a cross-wound package for example. Subsequently, this package is creeled in a twisting machine, for example a spindle assembly of two-for-one twisting machine, to twist the two strands about their common axis, so that a true twist forms, which has not only a common twist of both strands, but also a twist in the two individual strands.

Only as a result of such a twisting does a yarn form, which possesses an adequate strength for the subsequent processing steps and the desired properties necessary therefor.

For the strengthening and/or twisting of feed yarns having only a relatively small strength, which is understood within the scope of the present invention to include, for example, air-spun yarns as well as ply yarns, the use of a spindle assembly of a yarn twisting machine having a rotating pot mechanism could be considered. However, a precondition for strengthening and/or twisting the yarn with such a spindle assembly is that the feed yarn including a plied yarn has received a slight twist already in a preparatory processing step. For the purpose of strengthening and/or twisting such a feed yarn, which possesses already a slight preliminary twist, the feed yarn package is inserted into the pot mechanism of the twisting spindle assembly, which is then rotated, so that the feed yarn is withdrawn from the package, in most cases a double-flanged spool, while forming a balloon, and advanced to the yarn guide eyelet in the apex of the yarn balloon. As the spindle rotates, the pot surrounding the package rotates likewise, with the yarn balloon contacting the pot.

It is possible to keep the two strands of a ply yarn together, even after applying further methods, for example, by entangling or bonding segments thereof, possibly also by the application of a heat treatment depending on the quality and character of the feed yarn being processed.

When, subsequent to the spinning process, a package or an assembly wound package is present without an adequate preliminary twist of the individual yarn strand or of the two or more wound strands of yarn, it will be impossible to process such a yarn in a spindle assembly of a twisting machine having a rotary pot mechanism. The problem lies in the lacking strength in such a feed yarn. The yarn layers of the package separate from the package surface as a result of the centrifugal force which occurs during the rotation of the pot twisting spindle, and swing about the wound yarn package in a manner comparable to the rings of Saturn. Thus, it will not be possible to carry out a stable yarn strengthening and/or twisting process.

OBJECT AND SUMMARY OF THE INVENTION

It is the object of the present invention to create a method, which allows the use of a spindle assembly of a twisting machine, having a rotating mechanism for twisting and/or strengthening the feed yarn even when creeling a feed yarn having very little strength, which is loosely wound on a package.

To accomplish this object, the method of the present invention is characterized in that such a yarn package is inserted with the winding tube into the pot mechanism of the spindle assembly, preferably a pot twisting spindle, that the spindle pot is rotated, that subsequently the winding tube is pulled out of the wound yarn package and that the feed yarn is drawn off from the inside surface of the yarn package and finally wound to another package or twist yarn package. A pot twisting spindle is disclosed in German published patent application Auslegeschrift 1 123 239 and differs from a two-for-one twister spindle in that in the pot twisting spindle the outer surface of the yarn package fits closely against the inner surface of the pot.

The method of the present invention is substantially based on the fact that when the rotation starts, the yarn package expands by the action of the centrifugal force and separates from the winding tube inside, so that it becomes possible to remove the latter from the wound yarn package, to withdraw the feed yarn from the inside surface of the package, and to wind same into a package or twist yarn package.

According to a first embodiment, the feed yarn passes from the yarn package and pot mechanism in an upward direction to be wound into another package.

According to another embodiment, it is possible to use a multiple twist spindle assembly of a twisting machine having a hollow rotor mechanism rotating in the opposite direction to the rotation of the pot mechanism, so that the feed yarn which is withdrawn from the inside surface of the yarn package, is pulled into the hollow spindle shaft or rotor mechanism of the multiple twist spindle, so as to then follow the normal processing path of yarn through a multiple twist spindle.

Such a multiple twisting machine is described, for example, in German Patent 572,050, and differs from a standard two-for-one twisting machine in that in addition to the rotation of the spindle rotor, the package pot is likewise rotated oppositely to the rotary direction of the spindle rotor. To this end, a suitable intermediate gear is installed between spindle rotor and the package pot.

The feed yarn can be either an air-spun yarn as a single yarn or, in particular, a plied feed yarn comprising at least two individual yarns, which is wound into one ply yarn package from the two individual yarns.

To facilitate the locating and grasping of the feed yarn end after the removal of the tube from the yarn package, it is further provided by the invention that the yarn end located on the inside surface of the yarn package is placed on the winding tube, such as being secured in a slot at one end of the tube, at the beginning of the winding such that the yarn end remains secured to the tube when same it removed from the yarn package.

BRIEF DESCRIPTION OF THE DRAWINGS

The method of the present invention will be described below in greater detail with reference to the drawing in which.

DETAILED DESCRIPTION OF PREFERRED EMBODIMENT OF THE INVENTION

Figures 1A, 1B, 1C, 1D:
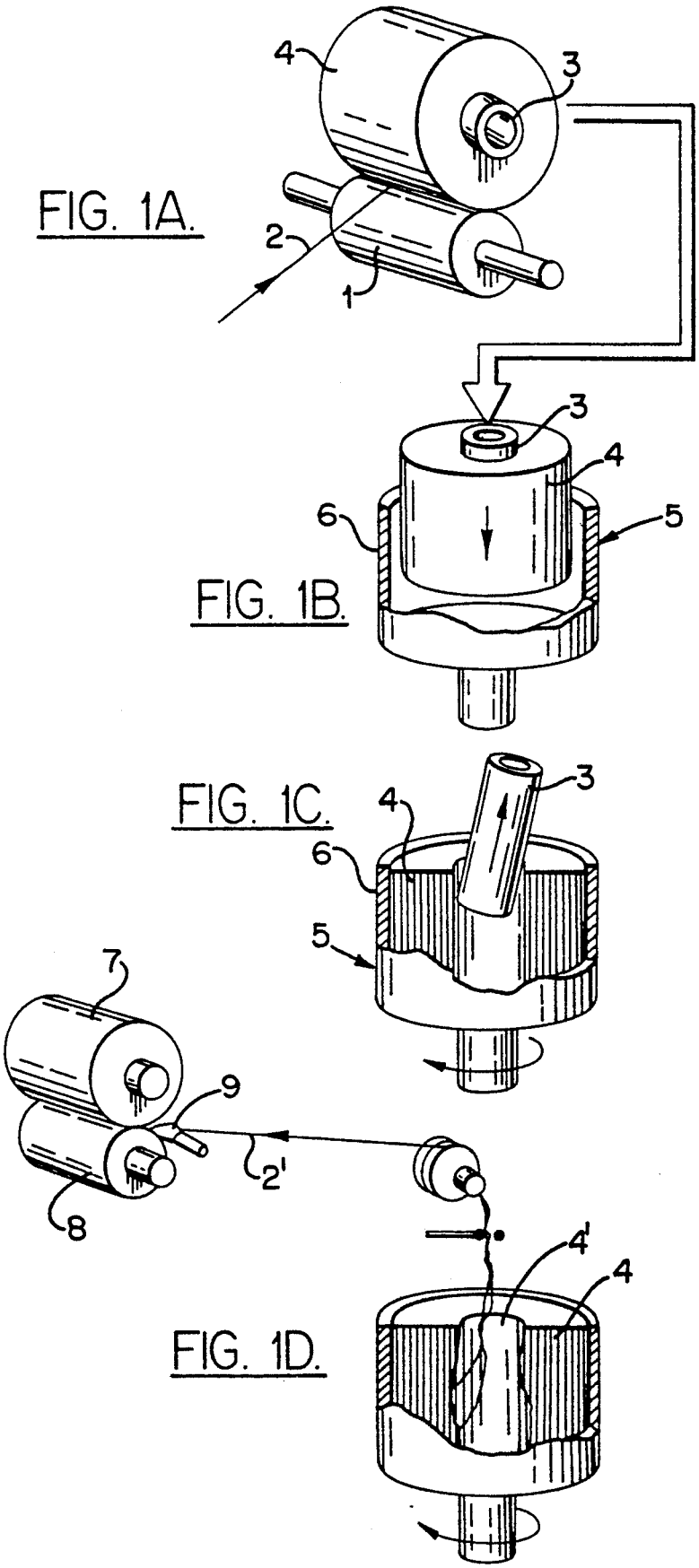
FIGS. 1A, 1B, 1C and 1D are schematic views illustrating sequential steps in the method of this invention.

FIG. 1 shows by way of illustrations A, B, C and D four successive steps of operation. According to FIG. 1A, a feed yarn 2 (air-spun yarn which is either a single or plied yarn) is wound under little tension on a tube 3 into a yarn package 4 by means of a standard takeup system, which comprises, among other things, a tangentially operative standard friction drive roll 1 and a stroke displacement device. Subsequently, the unit comprising the winding tube 3 and the wound yarn package 4 (FIG. 1B) is inserted into the rotating pot mechanism 6 of a spindle assembly 5 in a twisting machine, preferably a pot twisting spindle.

According to FIG. 1C, the pot mechanism 6 is put in rotation. As a result thereof the yarn on the yarn package 4 expands outwardly by the action of the centrifugal force, so that the winding tube 3 can be pulled out upwardly The feed yarn end which is located on the inside surface 4' of the yarn package 4 is then grasped and drawn off and passed or fed in upward direction as the pot mechanism continues to rotate. It becomes then possible to wind the thus strengthened or twisted yarn 2' in the usual manner into a cross-wound package 7 (FIG. 1D). FIG. 1D is a schematic illustration of a friction drive roll 8 with a traversing yarn guide 9 associated thereto.

Figure 2:
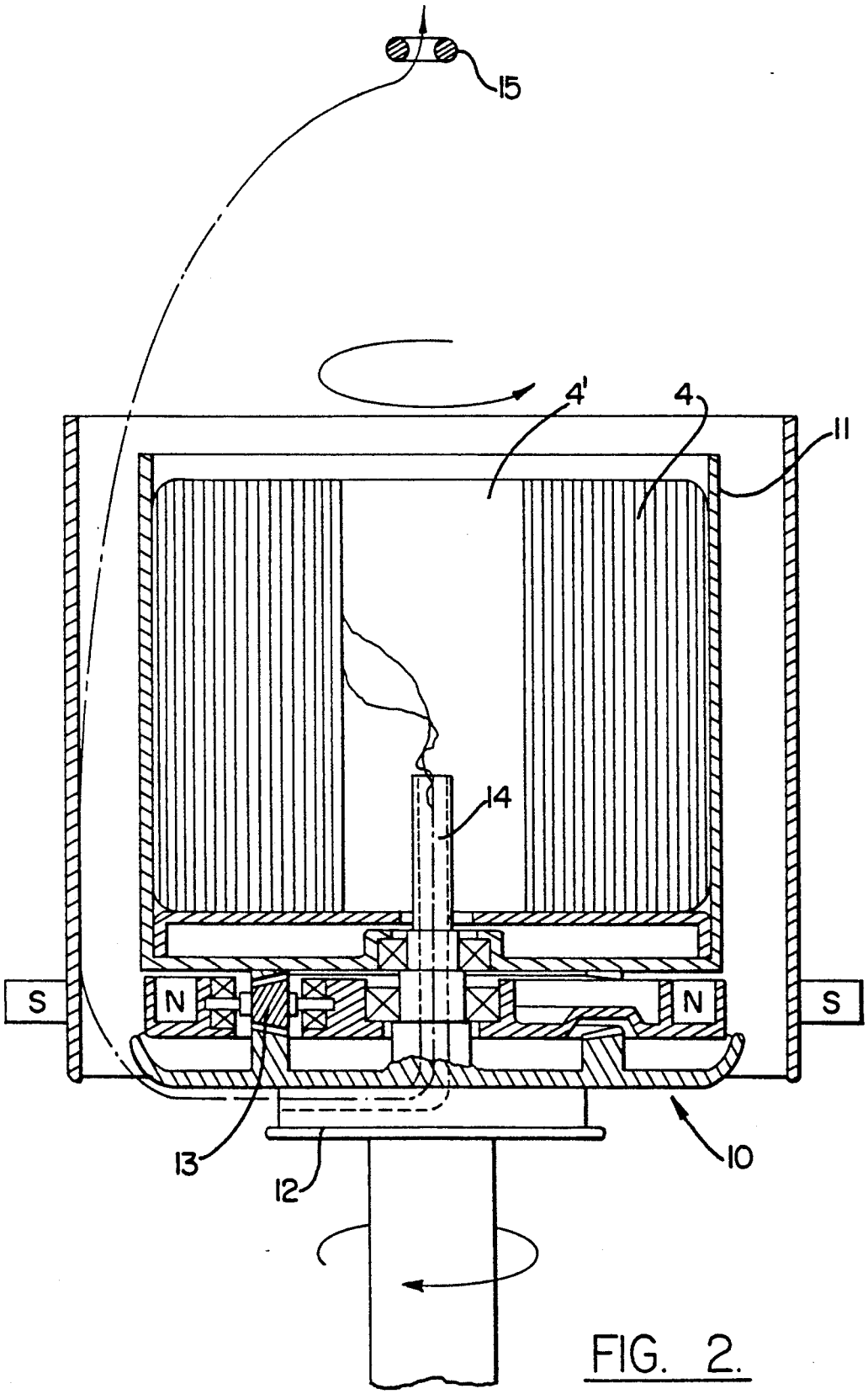
FIG. 2 is a sectional view through a portion of a spindle assembly of a cable twisting-machine.

FIG. 2 illustrates a variant in which a rotating pot mechanism 11 of multiple twist spindle assembly 10 of a twisting machine is used. In this multiple twist spindle assembly, the pot mechanism 11 is rotatably supported on the spindle rotor 12, is rotated in a direction opposite to the rotary direction of the spindle rotor mechanism 12 by means of an intermediate gear 13.

Likewise, when a device as shown in FIG. 2 is used, the unit comprising a winding tube 3 and a wound yarn package 4 is inserted, according to the step of operation B, into the pot mechanism 11, so as to then permit, according to the step of operation D, to pull the winding tube 3 out of the yarn package 4, as soon as the pot mechanism 11 has been put in rotation.

According to FIG. 2, the yarn which is withdrawn from the inside surface 4' of the yarn package 4, is pulled into the hollow spindle shaft 14 of the rotor mechanism 12, so as to advance upon leaving the yarn storage disk which forms a part of the spindle rotor mechanism 12, and while forming a balloon, to the yarn guide 15 defining the apex of the balloon, and to be finally wound in the usual manner into another cross-wound package. Since the cable twisting spindle assembly 10 which is used according to FIG. 2, is a device known per se, there is no need for a more detailed description of the further components of this spindle.

The feed yarn end located on the inside surface of the wound yarn package is preferably placed on the winding tube at the start of the winding in such a manner, such as being secured in a slot at one end of the tube, that the feed yarn end remains on the winding tube when the latter is pulled out of the yarn package so as to facilitate the locating and grasping of the feed yarn end.

What is claimed is:

1. Method of twisting a feed yarn in a spindle assembly of a yarn twisting machine having a rotating pot mechanism, said feed yarn having relatively small strength necessary to prevent yarn breakage and having been loosely wound on a tube under minimum tension allowing expansion of the yarn thereon; said method comprising the steps of:

inserting the loosely wound yarn package into the pot mechanism of the spindle assembly;

rotating the pot mechanism and yarn package and causing the wound yarn to separate from the winding tube in the yarn package by action of centrifugal force;

removing the separated winding tube from the yarn package; and withdrawing the feed yarn from the inside surface of the yarn package and winding the feed yarn into another yarn package while the pot mechanism is rotating.

2. Method, according to claim 1, in which said step of withdrawing the feed yarn from the inside surface of the yarn package and winding the feed yarn into another package further includes passing the feed yarn from the yarn package and pot mechanism in an upward direction to be wound into another package.

3. Method, according to claim 1, including utilizing a spindle assembly of a cable twisting-machine having a hollow spindle rotor mechanism rotating in the opposite direction to the rotation of the pot mechanism, and wherein said step of withdrawing the feed yarn from the inside surface of the yarn package and winding the feed yarn into another yarn package further includes passing the yarn from the yarn package through the hollow spindle rotor mechanism and then in an upward direction to be wound into another package.

4. Method, according to claim 1, 2 or 3, further including securing the leading end of the yarn to the winding tube prior to winding the yarn package so that when the winding tube is removed from the yarn package, the leading end of yarn is pulled out of the package.

5. Method, according to claim 1, 2 or 3, including providing an air-spun yarn as the feed yarn.

6. Method, according to claim 1, 2 or 3, including providing a plied yarn as the feed yarn.

* * * * *